US010214344B2

(12) United States Patent
Mastropasqua et al.

(10) Patent No.: US 10,214,344 B2
(45) Date of Patent: Feb. 26, 2019

(54) CARTRIDGE FOR EXTRACTING A BEVERAGE

(71) Applicant: ILLYCAFFE' S.P.A., Trieste (IT)

(72) Inventors: Luca Mastropasqua, Trieste (IT); Ferruccio Seganfreddo, Marostica (IT); Giuseppe Cutuli, Trieste (IT); Gianluca Giamba, Trieste (IT)

(73) Assignee: ILLYCAFFE' S.P.A., Trieste (IT)

( * ) Notice: Subject to any disclaimer, the term of this patent is extended or adjusted under 35 U.S.C. 154(b) by 8 days.

(21) Appl. No.: 15/326,079

(22) PCT Filed: Jul. 14, 2015

(86) PCT No.: PCT/EP2015/066015
§ 371 (c)(1),
(2) Date: Jan. 13, 2017

(87) PCT Pub. No.: WO2016/008865
PCT Pub. Date: Jan. 21, 2016

(65) Prior Publication Data

US 2017/0217669 A1 Aug. 3, 2017

(30) Foreign Application Priority Data

Jul. 16, 2014 (IT) ..... MI2014A1293

(51) Int. Cl.
*B65D 85/804* (2006.01)
*B65D 65/46* (2006.01)
*B65D 77/38* (2006.01)

(52) U.S. Cl.
CPC ..... *B65D 85/8043* (2013.01); *B65D 65/466* (2013.01); *B65D 77/38* (2013.01)

(58) Field of Classification Search
CPC .. B65D 85/8043; B65D 47/10; B65D 65/466; B65D 77/38
See application file for complete search history.

(56) References Cited

U.S. PATENT DOCUMENTS 329,920 A * 11/1885 Luedennann ..... B65D 47/10 215/253
8,499,682 B2 8/2013 Zangerle
(Continued)

FOREIGN PATENT DOCUMENTS

CN 158746 A 2/2005
CN 101310656 A 11/2008
(Continued)

OTHER PUBLICATIONS

Chinese Office Action dated Nov. 1, 2017 received in Chinese Patent Application No. 201580038404.2.
(Continued)

*Primary Examiner* — Erik Kashnikow
*Assistant Examiner* — Chaim A Smith
(74) *Attorney, Agent, or Firm* — Scully, Scott, Murphy & Presser, P.C.

(57) ABSTRACT

A cartridge for extracting a beverage by injecting a fluid, comprising a containment body which is adapted to contain a substance from which the beverage is to be extracted and is adapted to receive the fluid, the containment body comprising at least one opening for the outflow of the beverage, which is adapted to prevent an increase in hydraulic pressure inside the cartridge when the fluid is injected, the containment body further comprising a plurality of raised portions for hindering the flow of the beverage, which are arranged in a mutually offset arrangement around the outflow opening.

8 Claims, 6 Drawing Sheets

(56) References Cited

U.S. PATENT DOCUMENTS

| | | | | |
|---|---|---|---|---|
| 2006/0070999 | A1* | 4/2006 | Stull | B65D 47/10<br>220/257.2 |
| 2012/0097602 | A1* | 4/2012 | Tedford | B65D 65/466<br>210/500.1 |

FOREIGN PATENT DOCUMENTS

| | | | |
|---|---|---|---|
| CN | 101618785 | A | 1/2010 |
| CN | 102036885 | A | 4/2011 |
| EP | 1580143 | A1 | 9/2005 |
| EP | 1595817 | A1 | 11/2005 |
| WO | 03/047996 | A1 | 6/2003 |
| WO | WO 2007/063411 | A2 | 6/2007 |
| WO | WO 2012/121597 | A1 | 9/2012 |
| WO | WO 2013/124234 | A1 | 8/2013 |
| WO | WO 2013/192625 | A1 | 12/2013 |

OTHER PUBLICATIONS

International Search Report and Written Opinion dated Sep. 9, 2015 issued in PCT/EP2015/066015.

* cited by examiner

CARTRIDGE FOR EXTRACTING A BEVERAGE

The present invention relates to a cartridge for extracting a beverage by injecting a fluid preferably at low pressure, in particular in order to obtain filtered coffee, also known as American or drip brew coffee.

Currently several types of cartridges are known for obtaining beverages such as for example espresso coffee or the like, in which the internal volume of the cartridge that contains the substance to be extracted, for example ground roasted coffee, enables a good air seal. Such result can be obtained by using a single body for containing the substance, which is cup-shaped and sealed in an upper region by a film or by a rigid cover which can be perforated in order to allow the injection of the fluid, which is typically hot water.

In order to obtain beverages by way of injecting hot water at low pressure, for example filtered coffee, it is necessary however to prevent or reduce an increase of the hydraulic pressure inside the cartridge when the hot water is injected into it. To this end, it is known for the containment body of the substance to be provided with an opening of considerable size, such as to prevent this increase in pressure both at the start and during the percolation.

It is also known to seal such opening by way of a film, which must be manually torn or must be perforated by the machine before the extraction of the beverage.

A drawback of the known art is that the flow of the beverage exiting from the opening is not homogeneous or "mouse tail-like", which can render the conventional cartridge unsuitable for dispensing the beverage directly into a cup.

Another drawback is that manufacturing the conventional cartridges entails a step of applying the film that seals the opening for the outflow of the beverage, and such step lengthens or complicates the manufacturing.

The aim of the present invention is to provide a cartridge for extracting a beverage by injecting a fluid, which is capable of improving the known art in one or more of the above mentioned aspects.

Within this aim, an object of the invention is to provide a cartridge for extracting a beverage which enables a homogeneous outflow of the beverage and, as a consequence, makes it possible to dispense it directly into a cup or into a beaker.

Another object of the invention is to provide a cartridge for extracting a beverage which, during manufacturing, eliminates the step of applying a film to seal the opening for the outflow of the beverage.

Another object of the invention is to provide a cartridge for extracting a beverage which is highly reliable, easy to implement and low cost.

This aim and these and other objects which will become better apparent hereinafter are achieved by a cartridge for extracting a beverage by injecting a fluid, comprising a containment body which is adapted to contain a substance from which the beverage is to be extracted and is adapted to receive said fluid, the containment body comprising at least one opening for the outflow of the beverage which is adapted to prevent an increase in hydraulic pressure inside the cartridge when said fluid is injected, characterized in that said containment body comprises a plurality of raised portions for hindering the flow of the beverage, which are arranged in a mutually offset arrangement around said at least one outflow opening.

The aim and objects of the invention are likewise achieved by a cartridge for extracting a beverage by injecting a fluid, comprising a containment body which is adapted to contain a substance from which the beverage is to be extracted and is adapted to receive said fluid, the containment body comprising at least one opening for the outflow of the beverage which is adapted to prevent an increase in hydraulic pressure inside the cartridge when said fluid is injected, characterized in that the containment body comprises a closure body which is integrated in one piece with the containment body, a weakened region being provided between the closure body and the containment body around said at least one outflow opening, the weakened region being adapted to be broken manually so as to remove the closure body from the containment body in order to free said at least one outflow opening.

Further characteristics and advantages of the invention will become better apparent from the description of some preferred, but not exclusive, embodiments of the cartridge according to the invention, which are illustrated by way of non-limiting example in the accompanying drawings wherein.

Figure 1:
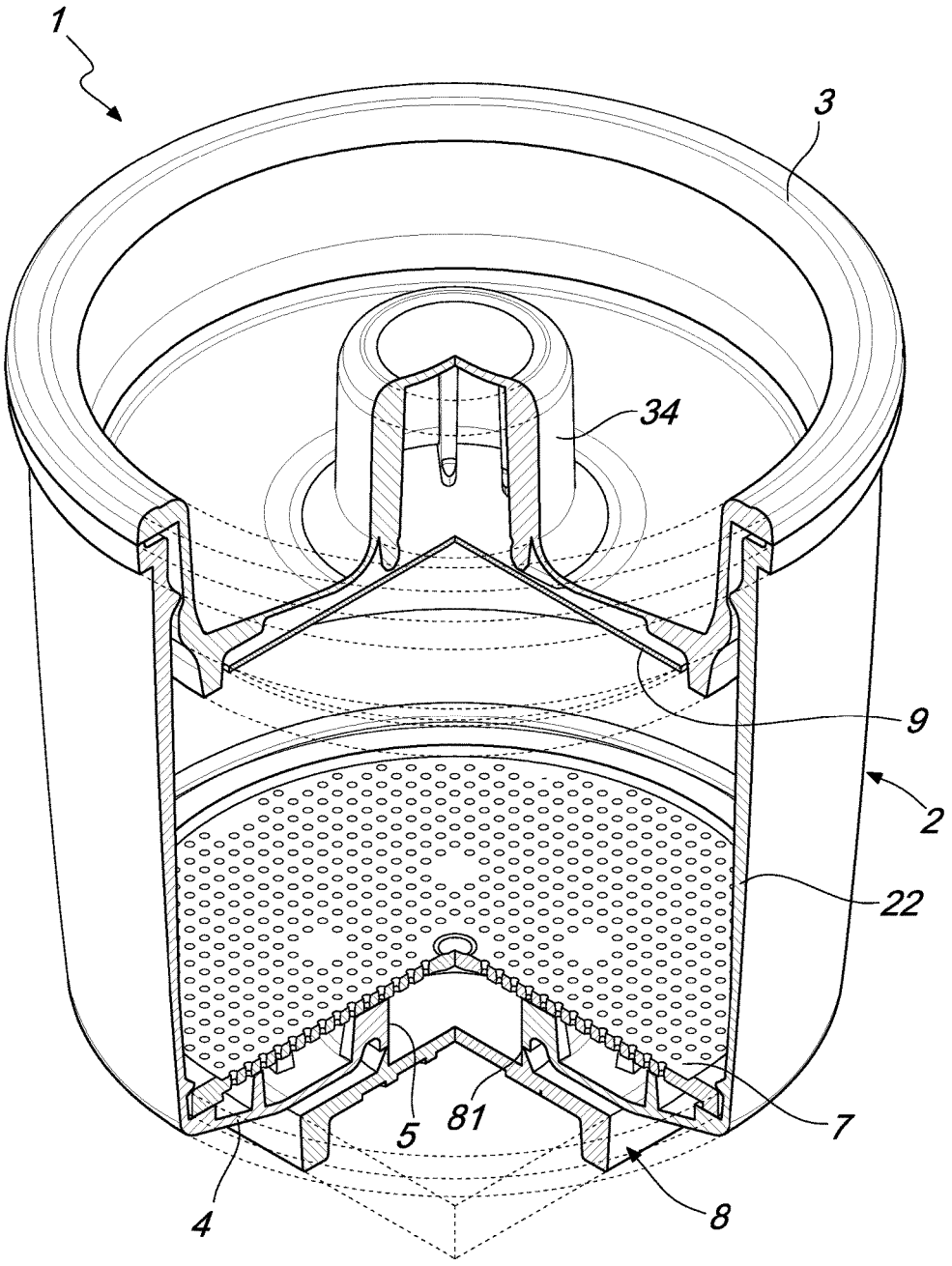
FIG. 1 is a cutaway view of a cartridge according to a first embodiment of the invention, in which the substance contained therein has been removed for clarity.
Figure 2:
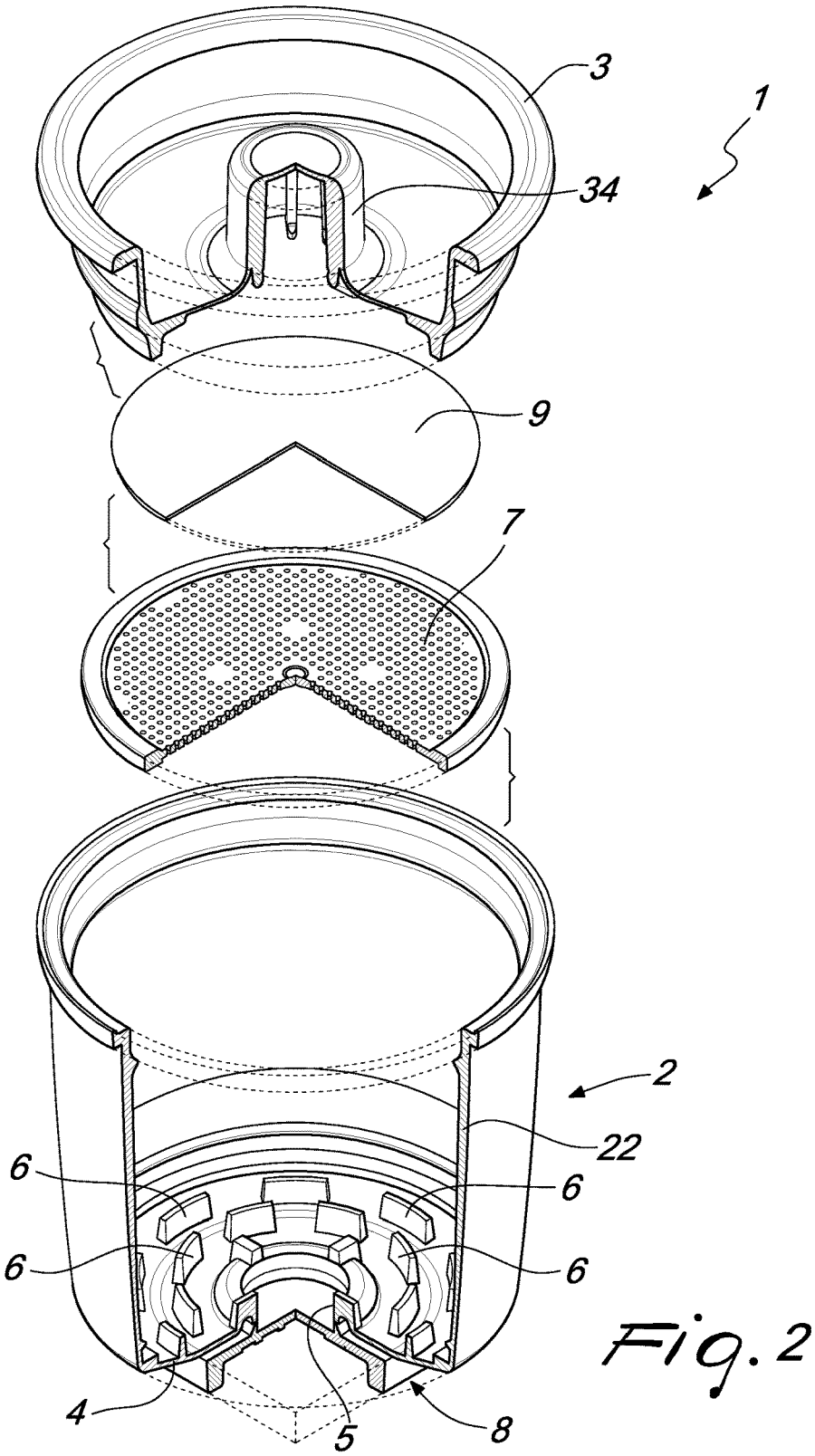
FIG. 2 is an exploded view of the cartridge in FIG. 1.
Figure 3:
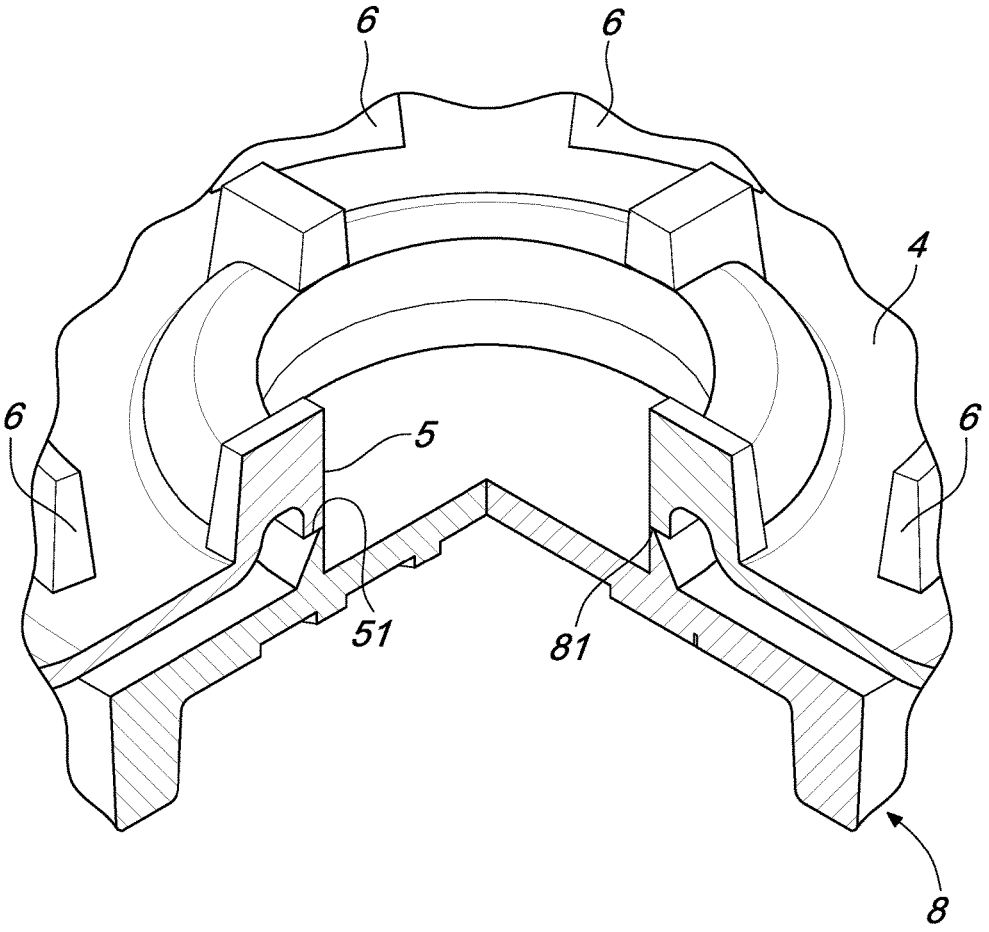
FIG. 3 is a detail view of the bottom of the cartridge in FIG. 1.
Figure 4:
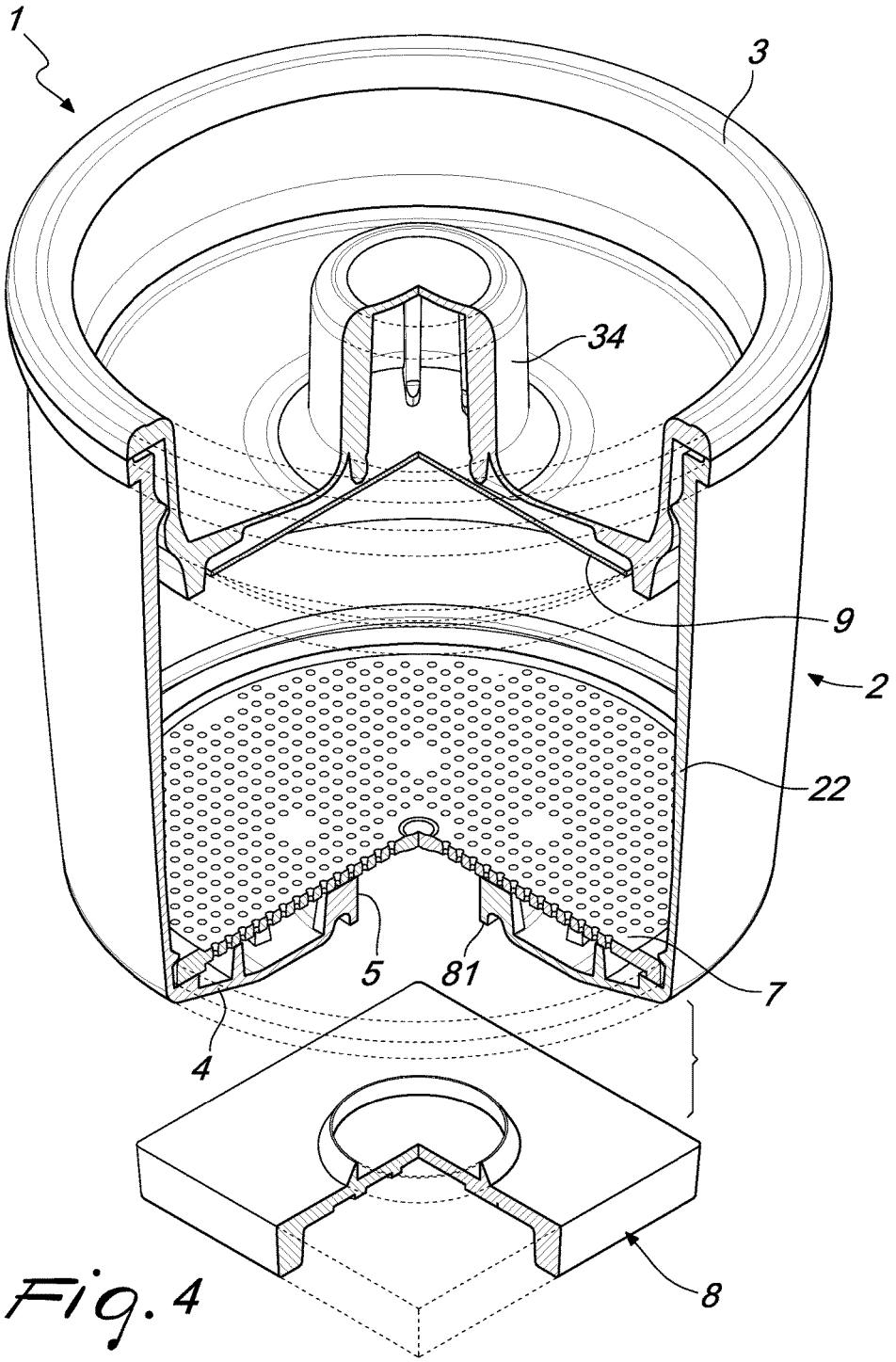
FIG. 4 is an exploded view of the bottom part only of the cartridge in FIG. 1.
Figure 5:
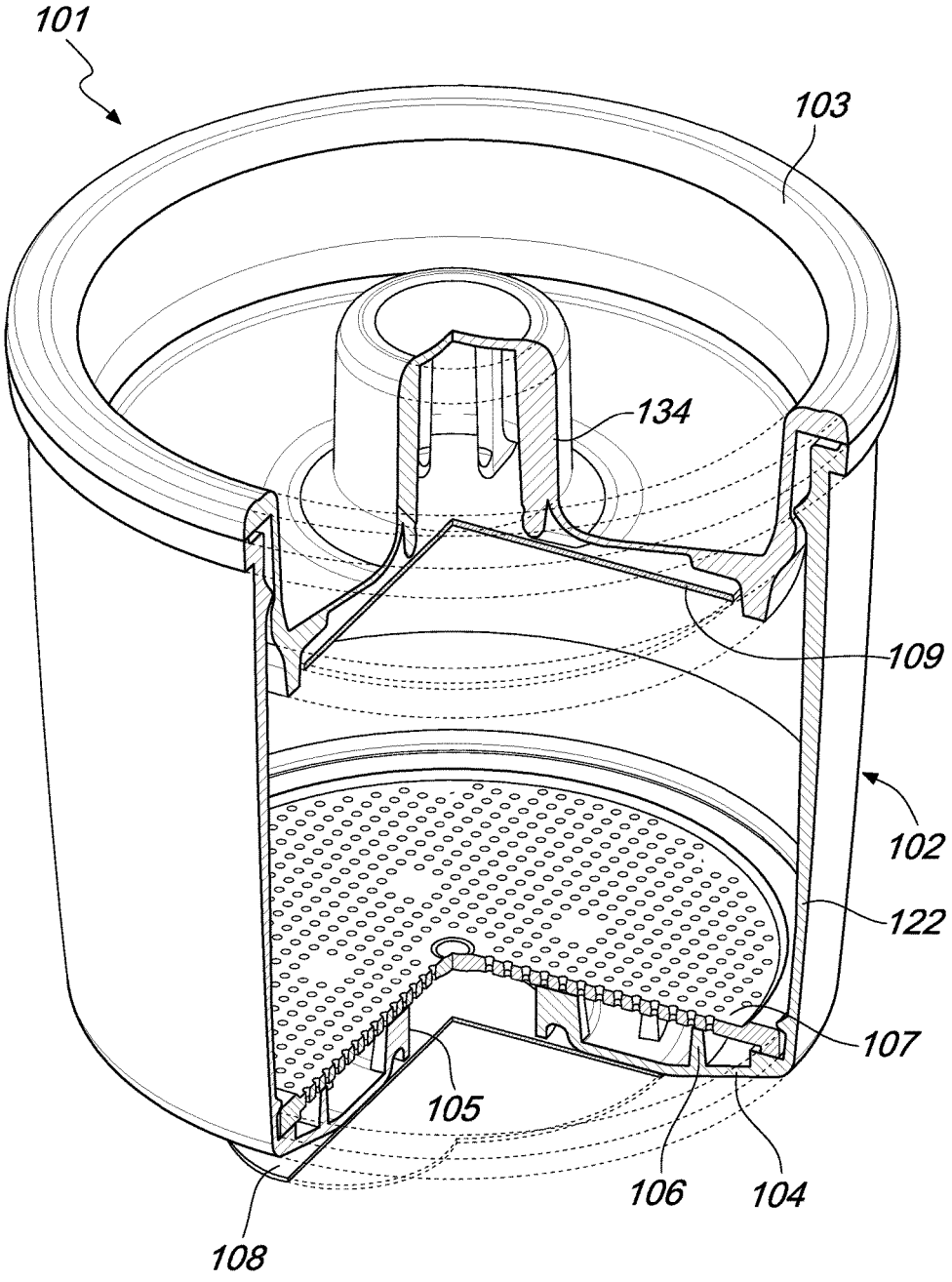
FIG. 5 is a cutaway view of a cartridge according to a second embodiment of the invention, in which the substance contained therein has been removed for clarity.
Figure 6:
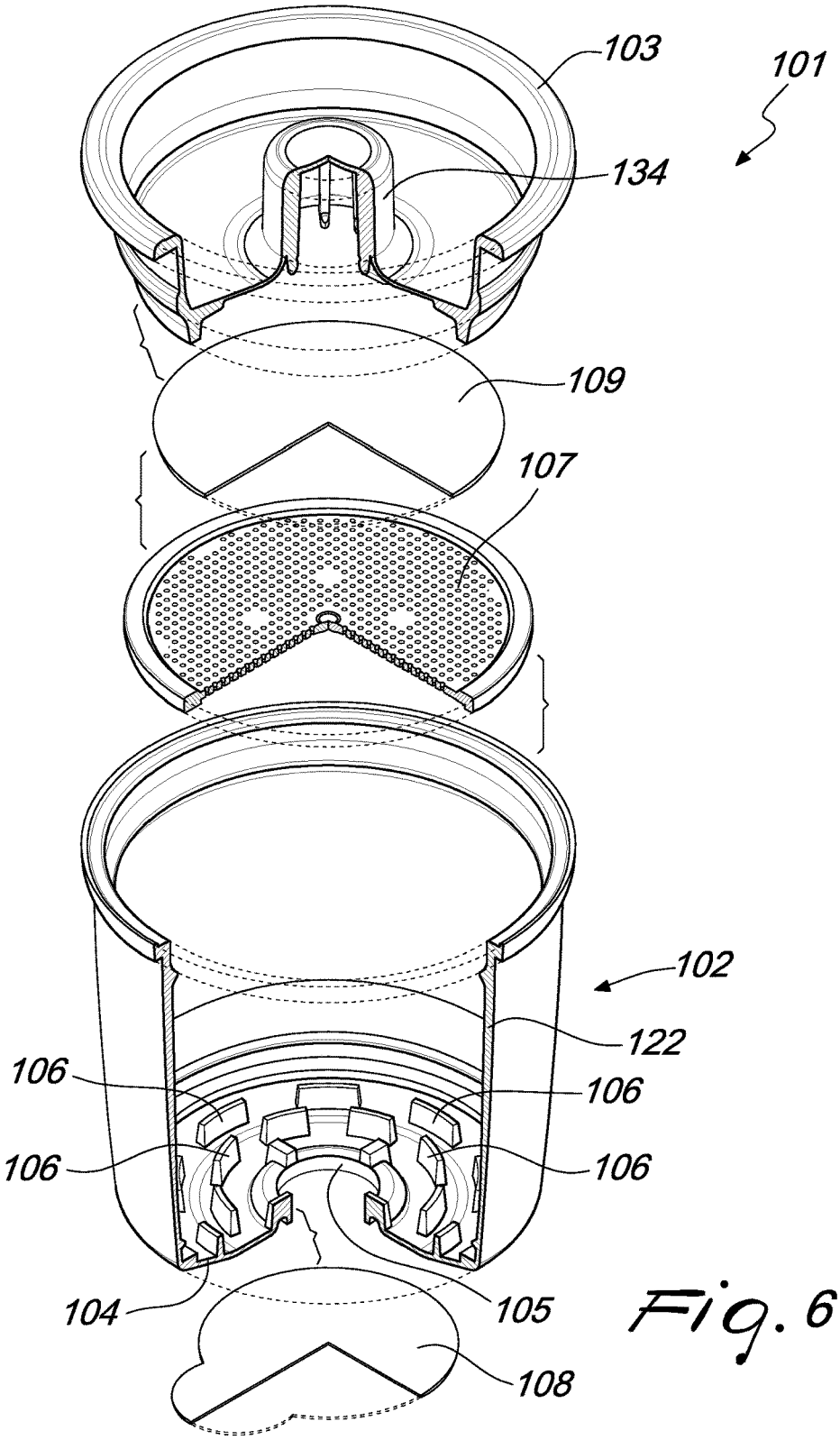
FIG. 6 is an exploded view of the cartridge in FIG. 5.

With reference to the figures, a cartridge according to the invention, generally designated by the reference numeral 1 or 101 according to the embodiment illustrated, comprises a containment body 2, 102 which is adapted to contain an edible substance, not shown, from which the beverage is to be extracted and adapted to receive a fluid, preferably at low pressure, in particular water.

In the preferred embodiments of the invention, the edible substance can be ground roasted coffee and the water at low pressure can be hot water, for example at around 90-99° C., and the pressure comprised between 0.5 bar and 1.5 bar, so that the beverage obtained is filtered coffee, also known as American coffee or drip brew coffee. The hot water can be injected into the cartridge 1, 101 by a machine that is known per se, even by gravity alone.

Alternatively, the substance contained in the cartridge can be soluble coffee, or any edible substance in powder form, in leaves or freeze-dried, or it can consist of a concentrate.

The containment body 2, 102 which can be made for example of a polymeric material using molding techniques such as, for example, injection and/or compression, heat-formation or extrusion, is cup- or beaker-shaped with at least one opening 5, 105 on the bottom and is sealed in an upper region by a cover 3, 103, which can be perforated so as to permit the injection of the fluid, in particular hot water, at low pressure.

In the embodiments illustrated, the cover 3, 103 is of the rigid type and is also made by way of molding (injection or compression), heat-formation or extrusion of a polymeric material. The cover 3, 103 can be perforated at a tubular spout 34, 134 thereof which protrudes from the cover 3, 103 outwardly from the cartridge 1, 101 in a substantially central position. However, for the purposes of the invention it is not necessary that the cover 3, 103 be of the rigid type, nor that it completely seals the upper part of the containment body 2, 102. For example, the cover can be a film or it can have one or more openings for the inflow of the fluid.

The cartridge 1, 101 can comprise a shower filter 9, 109 which is fixed preferably on the cover 3, 103 and which is adapted to receive the fluid at low pressure which is injected through the cover in order to distribute it substantially evenly on the edible substance contained in the cartridge 1, 101.

The shower filter 9, 109 can be made of filter paper, poly-coated paper, non-woven fabric or other film material with filtering capabilities against the solid particles of the substance contained in the cartridge 1, 101. The shower filter 9, 109 can alternatively be a rigid filter which is fixed by interference on the cover 3, 103, for example at the tubular spout 34, 134.

The containment body 2, 102 comprises a side wall 22, 122 and a bottom wall 4, 104, which has at least one opening 5, 105 for the outflow of the beverage which has an extent such as to prevent an increase in hydraulic pressure inside the cartridge when the fluid is injected. To this end, the opening 5, 105, during use, is free from obstruction, so that the beverage which passes through it exits from the cartridge 1, 101 and is poured directly into the cup without encountering obstacles which could cause an increase in hydraulic pressure inside the cartridge 1, 101.

The outflow opening 5, 105 can be provided so as to usually be closed and be opened only at the moment of use.

In particular, in the first embodiment, the containment body 2 comprises a closure body 8, which is provided in one piece with the containment body 2 during molding so as to be connected to the bottom wall 4 by way of a weakened region 81.

The closure body 8 can be removed by the user by breaking the weakened region 81 before using the cartridge, by way of a rotary motion and/or tearing of the closure body 8 with respect to the containment body 2.

In this manner, it is possible to manufacture any cartridge for extracting a beverage without entailing a step of applying a closure film on the opening for the outflow of the beverage.

In order to close the outflow opening of the invention it is in any case possible, for example in the second embodiment described herein, to use a closure film 108 of the traditional "peel-off" type, instead of the closure body 8.

Alternatively, the outflow opening 105 need not be closed and a secondary packaging can be used to preserve the cartridge 101 before use.

Returning to the first embodiment, the weakened region 81 is arranged preferably so as to surround the outflow opening 5, for example at an outer rim 51 of the outflow opening 5.

The closure body 8 is preferably flat in shape and even more preferably has a profile with sharp edges, for example substantially square in plan, so as to facilitate the manual grip and the consequent removal by rotation and/or tearing.

The bottom wall 4, 104 of the containment body 2, 102 can comprise a plurality of raised portions 6, 106 which protrude from the bottom wall 4, 104 inwardly into the cartridge 1, 101 and which are arranged in a mutually offset arrangement around the outflow opening 5, 105 in order to define obstacles to the flow of the beverage in the radial direction toward the opening 5, 105.

The raised portions 6, 106 are arranged on closed lines, for example circumferences, which are substantially concentric to the axis of the cartridge 1, 101 or of the outflow opening 5, 105, in a mutually offset manner in order to break the flow of beverage which is directed toward the outflow opening 5, 105 and prevent the establishment of preferential channels for the outflow of the beverage. On encountering a raised portion 6, 106 the flow will go around the obstacle, being directed toward the region of lower pressure, in so doing making the distribution of the flow uniform around the opening 5, 105. As a consequence, the beverage flows from the cartridge 1, 101 toward the cup vertically.

The raised portions 6, 106 can be wall-shaped, or they can be substantially planar, and can be arranged on two concentric circumferences as in the embodiments illustrated, so that the raised portions 6, 106 of one circumference are offset with respect to the raised portions 6, 106 of the adjacent circumference, i.e. each raised portion of one circumference radially faces the separation region of two adjacent raised portions of the adjacent circumference, without letting channels to radially cross the two circumferences up to the opening of outflow 5, 105. The distance between two concentric circumferences can be comprised between 1 mm and 4 mm, for example 3 mm.

The raised portions 6, 106 can be arc-shaped, with a center angle comprised between 15° and 30°, for example 22.5°.

Advantageously, the raised portions 6 and 106 also perform the function of supporting a lower filter 7, 107, for example a rigid filter obtained by molding a polymeric material which is provided with a plurality of holes for filtering the substance contained in the cartridge 1, 101. Each one of such filtering holes is conveniently contoured internally with two mutually opposite splays which define two conic sections that converge substantially in the center of the channel defined by the filtering hole.

One or more of the components described above of the cartridge 1, 101 can be made of a thermoplastic polymer, synthesized from traditional sources (such as oil) or from renewable sources (for example by fermentation of alcohols). The thermoplastic polymer is selected from the group that comprises polypropylene, polystyrene, polyamide, vinyl alcohol resin (for example, ethylene vinyl alcohol, EVOH), polyethylene or polyethylene terephthalate (PET). Any one of these thermoplastic polymers can be used in order to provide any component of the cartridge 1, 101, in particular for the cover 3, 103, the containment body 2, 102, the shower filter 9, 109, the lower filter 7, 107. Two or more of the above mentioned thermoplastic polymers, in one or more of such components, can be mutually coupled through manufacturing processes such as heat-formation or co-injection molding. For example, one or more of the components of the cartridge 1, 101 can be a multilayer component, composed of two or more of the thermoplastic polymers listed above.

One or more of the components described above of the cartridge 1, 101 can be made of a biodegradable material, selected from the group that comprises biodegradable polyesters (for example PLA), starch-based biodegradable materials, microbial polyesters, biodegradable vinyl alcohol resins (for example PVOH), biobased thermoplastics, and polyhydroxyalkanoates (PHA). Any one of these biodegradable materials can be used in order to provide any component of the cartridge 1, 101, in particular for the cover 3, 103, the containment body 2, 102, the shower filter 9, 109, the lower filter 7, 107. Two or more of the above mentioned biodegradable materials can be mutually coupled. For example, one or more of the components of the cartridge 1, 101 can be a multilayer component composed of two or more of the biodegradable materials listed above.

Operation of the cartridge according to the invention is evident from the foregoing description.

Although the cartridge according to the invention has been devised specifically for the extraction of filtered coffee from roasted coffee ground to a suitable fineness, it can also be used, more generally, for the extraction of beverages from portioned ingredients.

The cartridge, thus conceived, is susceptible of numerous modifications and variations, all of which are within the scope of the appended claims. Moreover, all the details may be substituted by other, technically equivalent elements.

In practice, the materials employed, as well as the dimensions, may be any according to requirements and to the state of the art.

The disclosures in Italian Patent Application No. MI2014A001293 from which this application claims priority are incorporated herein by reference.

The invention claimed is:

1. A cartridge for extracting a beverage by injecting a fluid, comprising a containment body which is adapted to contain a substance from which the beverage is to be extracted and is adapted to receive said fluid, said containment body comprising at least one outflow opening for the outflow of the beverage which is adapted to prevent an increase in hydraulic pressure inside the cartridge when said fluid is injected, wherein said containment body comprises a plurality of raised portions configured to hinder the flow of the beverage, which are arranged in a mutually offset arrangement around said at least one outflow opening, wherein said raised portions are arranged along at least two closed lines which are substantially concentric with respect to said at least one outflow opening so that the raised portions of one line are offset with respect to the raised portions of the adjacent lines, so that each raised portion of one line radially faces the separation region between two adjacent raised portions of the adjacent lines, so as to prevent the presence of radial channels along the bottom wall of the containment body toward said at least one outflow opening.

2. The cartridge according to claim 1, wherein said at least two closed lines are respective circumferences.

3. The cartridge according to claim 1, wherein said raised portions are substantially arc-shaped.

4. The cartridge according to claim 1, wherein said containment body comprises a closure body which is integrated in one piece with the containment body, a weakened region being provided between said closure body and said containment body around said at least one outflow opening, said weakened region being adapted to be broken manually so as to remove said closure body from said containment body in order to free said at least one outflow opening.

5. The cartridge according to claim 4, wherein said closure body has a profile with sharp edges.

6. The cartridge according to claim 1, wherein said at least one outflow opening is closed by a film.

7. The cartridge according to claim 1, wherein one or more of the components of the cartridge is made:

of a thermoplastic polymer, selected from the group consisting of polypropylene, polystyrene, polyamide, vinyl alcohol resin, polyethylene, and polyethylene terephthalate;

or of a combination of at least two thermoplastic polymers selected from the group consisting of polypropylene, polystyrene, polyamide, vinyl alcohol resin, polyethylene, and polyethylene terephthalate.

8. The cartridge according to claim 1, wherein one or more of the components of the cartridge is made:

of a biodegradable material selected from the group consisting of biodegradable polyesters, starch-based biodegradable materials, microbial polyesters, biodegradable vinyl alcohol resins, bio-based thermoplastics and polyhydroxyalkanoates;

or of a combination of at least two biodegradable materials selected from the group consisting of biodegradable polyesters, starch-based biodegradable materials, microbial polyesters, biodegradable vinyl alcohol resins, bio-based thermoplastics and polyhydroxyalkanoates.

* * * * *